United States Patent [19]

Simon et al.

[11] 4,221,346

[45] Sep. 9, 1980

[54] FEEDER MAGAZINE FOR CONTINUOUSLY OPERATING FILM-DEVELOPING MACHINES

[75] Inventors: Joachim Simon, Erkrath; Werner Wachholder, Solingen; Hans-Georg Seifert, Düsseldorf, all of Fed. Rep. of Germany

[73] Assignee: Hostert AutomataDusseldorf GmbH & Co., Düsseldorf, Fed. Rep. of Germany

[21] Appl. No.: 963,306

[22] Filed: Nov. 24, 1978

[30] Foreign Application Priority Data

Dec. 31, 1977 [DE] Fed. Rep. of Germany ..... 2759175

[51] Int. Cl.[3] ..... B65H 25/00; B65H 25/32; B65H 51/20

[52] U.S. Cl. ..... 242/55.01

[58] Field of Search ..... 226/11, 10, 118, 119, 226/24, 38, 43, 44; 242/55.01, 45, 75.5, 75.51, 75.52, 75.53, 47.5

[56] References Cited

U.S. PATENT DOCUMENTS

| | | | |
|---|---|---|---|
| 1,629,030 | 5/1927 | Garbutt | 242/55.01 |
| 1,679,096 | 7/1928 | Pourfillet et al. | 242/55.01 |
| 2,016,083 | 10/1935 | Ensign et al. | 242/55.01 |
| 2,048,182 | 7/1936 | Ybarrondo | 242/55.01 |
| 2,146,170 | 2/1939 | Brenbarger et al. | 242/55.01 |
| 3,049,308 | 8/1962 | Lang | 242/45 |
| 3,089,658 | 5/1963 | Good | 242/55.01 |
| 3,370,801 | 2/1968 | Ames | 242/55.01 |
| 3,669,375 | 6/1972 | Bruton | 242/55.01 X |

*Primary Examiner*—Stanley N. Gilreath

*Attorney, Agent, or Firm*—Mandeville and Schweitzer

[57] ABSTRACT

A feeding mechanism is provided for feeding continuously operating film-developing machines in which provision is made preventing retraction of already fed film from the developing machine in the event of breaking of the film. The invention includes arrangements for arresting the feeding operation with the film movement stopping at the place where it is located when the breaking occurs. Sensors are provided for engaging the guide rolls for the film to determine when no film is present. The sensors are connected to brakes for the activation thereof when no film is present in the guide rolls. The device of the invention includes provision for continuously feeding the last of a roll of film while a new roll is being inserted.

10 Claims, 3 Drawing Figures

FEEDER MAGAZINE FOR CONTINUOUSLY OPERATING FILM-DEVELOPING MACHINES

BACKGROUND AND DESCRIPTION OF THE INVENTION

The invention relates to a feeder magazine for feeding to continuously operating film-developing machines, with guide rolls in the feeder magazine for the film material running into the film-developing machine, mounted on parallel shafts arranged one above the other. The lower shaft, on which the lower guide rolls are mounted, is mounted on a slide which can be moved on vertical columns.

The slide, which carries the lowest set of rolls, is referred to as the elevator which acts as a buffer for inserting a new spool of film, whose material extends about the upper and lower rolls, so that, when inserting a new roll of film, there is no need to interrupt the operation and particularly the discharging of the roll of film already inserted. Rather, the elevator ensures that a sufficient volume of film material is available for feeding, so that the film material is able to run continuously further into the film-developing machine, while a new spool is being inserted.

It is a disadvantage of the known feeder magazines that, should a tear occur in the film material which is running into or through the film-developing machine, especially while or shortly before a new spool of film is inserted, at which time the elevator has already moved up from its lower position, the elevator, because of its weight, moves downward relatively rapidly to its lowest position. As a result, the length of film material in the buffer or magazine increases and a corresponding amount of film material is retracted from the film-developing machine.

This leads to a situation in which film material, already developed or partially developed, is pulled in the opposite direction through the baths of the film-developing machine and may even return into the feeder magazine. As a consequence, in any case this part of the film material is disadvantageously affected and, under certain circumstances, may even become seriously damaged or totally unusable.

It is an object of the invention to avoid these disadvantages and to create a feeder magazine for continuously operating film-developing machines which, in case of a tear in or break of the film material, is not able to retract any film material from the film-developing machine and which does not exert any force on the film material, inserted or running out of the magazine, which would favor the formation of a tear or break.

This object is accomplished, in accordance with the invention, in the case of a feeder magazine of the type mentioned at the beginning, by the fact that at least one sensor, acting on one of the upper guide rolls and at least one brake, controlled by this sensor, are provided for the upper guide rolls and/or for the slide carrying the lower guide rolls. In so doing, each of the upper guide rolls has a sensor assigned to it, which, for example, is constructed as a lever, on the free end of which there is a feeler roll, which moves into a groove of the guide roll, when there is no film material running over this guide roll.

At the same time, all sensors are, preferably, mounted on a common shaft, which is constructed as a control element for the brake or brakes. Accordingly, the sensors are linked by an electrically conducting connection with this shaft and in each case has a contact, which can make contact with an electrically conducting rod, in order to close a control circuit when the various sensors are in particular position; namely, when they rest on film material running over the guide roll concerned. If at least one of the sensors is not resting on film material, and consequently can move into a groove of the guide roll concerned, contact with the electrically conducting rod and therefore with the control circuit is interrupted or closed, which immediately leads to an activation of the brake or brakes.

The brakes may be, for example, electromagnetic brakes. Preferably, two brakes are provided, one of which brakes the slide carrying the lower guide rolls, while the other brakes the upper guide rolls. At the same time, the brake for the upper guide rolls may have at least one axle, which is parallel to the shaft carrying the upper guide rolls and on which brake shoes are arranged, which can be displaced eccentrically, so that effective braking is achieved in the shortest displacement paths.

A further characteristic, with which a retraction of film material, which has already run into the film-developing machine, can be avoided, consists of the fact that the outlet roll of the feeder magazine, seated on the upper shaft, is equipped with a freewheeling system acting in one direction of rotation, so that this roll can be turned only in the outlet direction of the film material and not in the opposite direction.

In order to ensure a particularly easy running of the film material through the guide rolls which guide the feeder magazine, and in order to produce as little tension as possible in the film material, all guide rolls have, according to a further characteristic of the invention, extremely large ball bearings, and counter weights are arranged on the lower guide rolls. By these means, the danger of tearing the film material is reduced further.

Preferably, the sensors act together with several, and advisably with all of the upper guide rolls so that tearing of the film material at any position within the feeder magazine can be detected as quickly as possible and a braking effect brought about before the elevator or slide for the lower guide rolls has been displaced downwards by a detectable distance. When the slide for the lower guide rolls is braked practically immediately as the film material in the feeder magazine tears, there is no danger that the film material can be retracted from the film-developing machine into the feeder magazine. If the individual sensors are constructed as a whip roll, a particularly compact and safe operation of the control is possible.

DESCRIPTION OF THE DRAWINGS

An example of the operation of the inventive feeder magazine for continuously operating film-developing machines is shown schematically in the drawings.

DETAILED DESCRIPTION OF THE INVENTION

Figure 1:
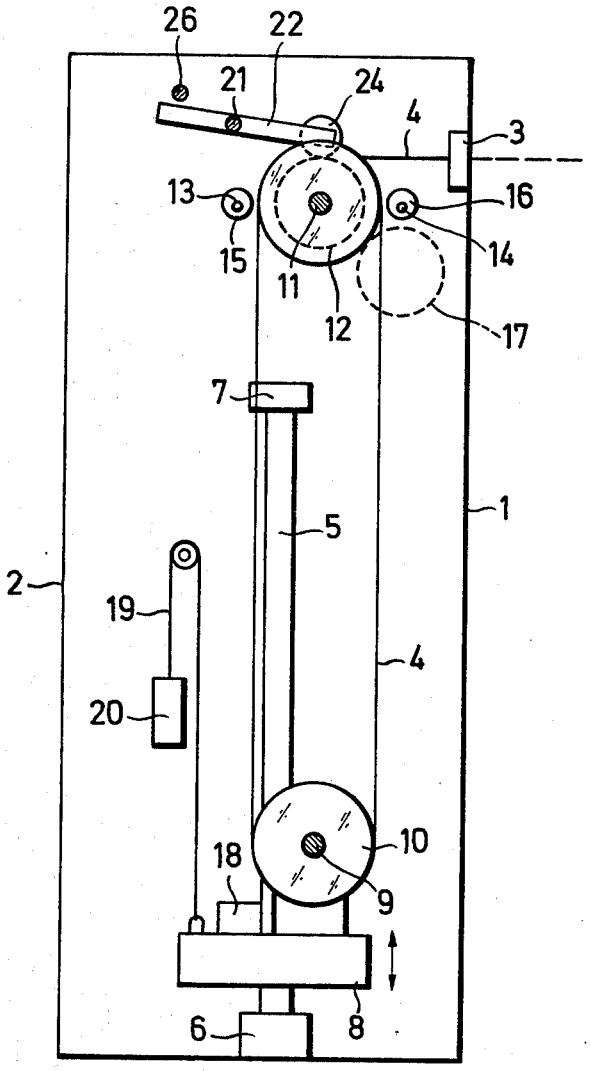
FIG. 1 shows a side elevation of the whole of the feeder magazine.

The feeder magazine has a closed housing 1, which is accessible at its front side by means of a door 2. On the rear side, there is a gate 3, through which the film material can run out into a continuously operating film-developing machine, which is not shown. A slide 8, which can be displaced vertically, is supported in the housing 1 on spaced vertical side columns 5, which are secured in end bearings 6 and 7. Slide 8 supports a horizontal shaft 9, on which a large number of lower guide rolls 10 for the inserted film material 4 are arranged next to one another.

In the upper region of housing 1, a further shaft 11 is rotatably supported. The upper guide rolls 12 are rotatably supported on shaft 11. Parallel to shaft 11, there are two axles 13 and 14, on which roll-like brake shoes 15 and 16 are mounted, which can be displaced eccentrically by an electromagnetic brake 17, mounted on the outside of the housing. These brake shoes engage the outer edge of the upper guide rolls for the purpose of braking them.

A brake 18 is mounted on slide 8 and becomes activated in case of a tear or a break of the film material 4 running through the feeder magazine. For example, the brake engages the vertical guides 5 or a drive, which is not shown, in order to hold slide 8, which normally pulls downward because of its weight, in the elevated position which it has just reached. By means of cable 19, counter weights 20 hold slide 8, which is shown in FIG. 1 in its lowest position. Also, these counter weights 20 dampen too rapid a downward movement of slide 8, and prevent too great a tension being exerted on the film material by the weight of slide 8.

Next to and somewhat above shaft 11 in housing 1, a further shaft 21 is provided on which a large number of levers 22, acting as sensors, are pivotally supported. In the example of the operation shown, each lever is made from sheet metal and has a fork 23 at one end, between the arms of which a feeler roll 24 is supported so that it may rotate. The other end of each lever 22 lies beneath an electrically conducting rod 26, which is mounted in housing 1 and which is normally not touched by the levers 22. Each lever 22 has, in its central region, a metal bushing 27, with which the lever is supported on shaft 21.

Figure 2:
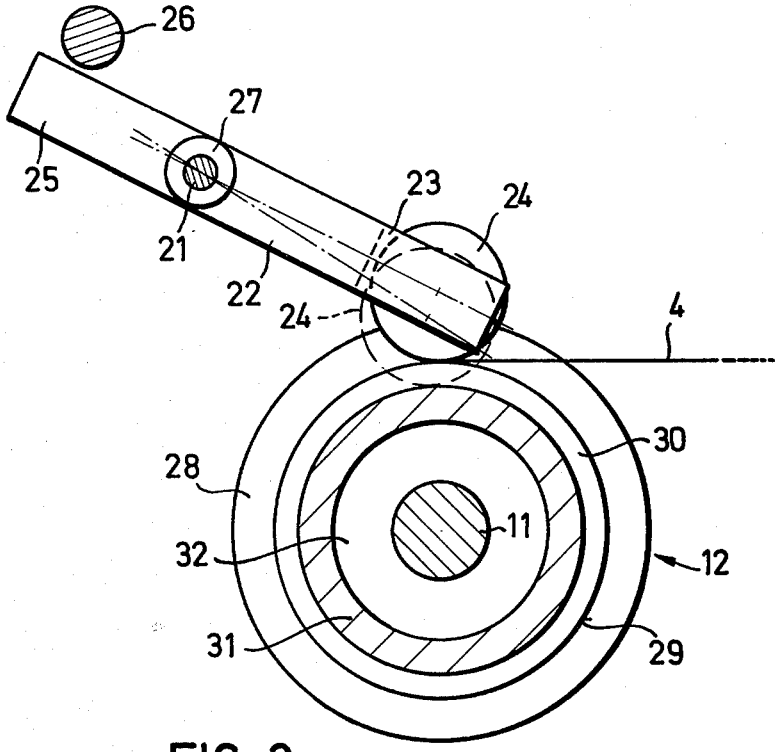
FIG. 2 shows a section through an upper guide roll, in which the sensor can be recognized, which works together with the guide rolls and is constructed as a tiltable lever and which, when the film material, running over the guide roll, fails to appear because of a break of a similar happening, is tilted in such a manner that its rear end makes contact with an electrically conducting rod.
Figure 3:
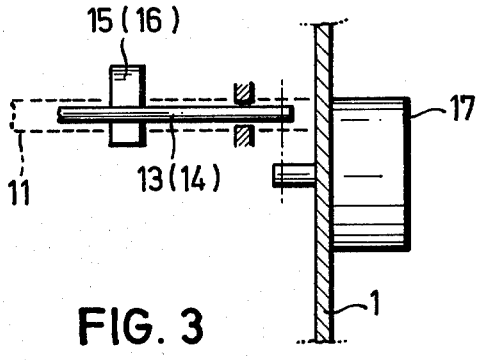
FIG. 3 shows a partial section through a side wall of the housing of the feeder magazine, from which the arrangement of the brake, which acts together with the other guide rolls, can be recognized.

As shown in FIG. 2, each upper guide roll 12 has between the outer flanges 28 a circular shoulder 29 and the film material, guided over this guide roll 12, rests on the shoulders 29 which lie opposite to one another. Between the two shoulders 29, only one of which can be seen in FIG. 2, there is a circular groove 30, into which a feeler roll 24 extends when no film material is running over guide roll 12, as indicated by the dashed lines in FIG. 2. Lever 22 is then pivoted about shaft 21 in such a manner, that its rear end 25 moves upward and comes into contact with rod 26, closing a control circuit (not shown for clarity) which switches on brakes 17 and 18. This causes an immediate stop in the rotational movement of the upper guide rolls 12, and the vertical movement of slide 8. Brake 18 causes slide 8 to brake immediately, while brake 17 causes rolls 15 and 16, which act as brake shoes, to engage the outer edges of flanges 28 of the individual upper guide rolls 12.

Within the hub 31 of each guide roll 12, there is a large ball bearing arrangement, shown only schematically at 32, with the help of which the guide roll 12 concerned, is supported rotatably on shaft 11. The outlet roll, or upper guide roll 12, from which the film material is guided to gate 3, preferably has a freewheel, which permits the roll to rotate only in the outlet direction and prevents it from turning in the reverse direction.

This feeder magazine, of which only the most important parts are shown in the drawings and which also, in part, is only indicated schematically, effectively prevents film material being retracted through gate 3 of the film-developing machine, which is not shown, in the case that a tear occurs in the film material present in the feeder magazine. In addition, should there be a tear in the film material, larger stresses on the film material remaining in the magazine are avoided. Furthermore, in normal operation, the tension exerted on the film material 4 is uniform but not extremely high, so that, as far as possible, the film material will not tear at all.

We claim:

1. Apparatus for feeding film to a continuously operating film-developing machine, comprising (a) a housing;

(b) an upper horizontal shaft mounted in said housing;

(c) a plurality of spaced-apart upper guide rolls rotatably mounted on said upper shaft;

(d) a pair of spaced-apart vertical columns mounted in said housing;

(e) a slide extending between said columns and mounted for vertical sliding movement thereon;

(f) a lower horizontal shaft mounted on said slide;

(g) a plurality of spaced-apart lower guide rolls rotatably mounted on said lower shaft; the improvement characterized by (h) sensing means mounted for engagement with at least one of said upper guide rolls for sensing the presence or absence of film on said one guide roll;

(i) first brake means on said slide and connected to said sensing means for arresting the vertical movement of said slide; and (j) second brake means connected to said sensing means and adjacent said plurality of upper guide rolls, said second brake means mounted for braking engagement with said plurality of upper guide rolls;

(k) whereby when said sensing means senses the absence of film on said one upper guide roll said first and second brake means are activated.

2. The apparatus of claim 1, further characterized by (a) separate sensing means mounted for engagement with each of said spaced-apart upper guide rolls.

3. The apparatus of claim 2, further characterized by said sensing means including (a) a common shaft;

(b) all said separate sensing means mounted on said common shaft; and (c) said common shaft connected for actuating said first and second brake means.

4. The apparatus of claim 3, further characterized by (a) said first and second brake means being electromagnetic brakes.

5. The apparatus of claim 4, further characterized by said second brake means including (a) a pair of brake shafts mounted parallel to said upper shaft on either side thereof;

(b) a brake shoe mounted on each brake shaft for engagement with each of said plurality of upper guide rolls; and (c) said brake shoes mounted eccentrically on said brake shafts.

6. The apparatus of claim 1, further characterized by (a) each of said plurality of upper guide rolls mounted for rotation in the feed direction; and (b) means on said plurality of upper guide rolls preventing rotation in the non-feed direction.

7. The apparatus of claim 1, further characterized by (a) enlarged ball bearing means on each of said plurality of upper and lower guide rolls;

(b) said enlarged ball bearing means disposed between said rolls and their respective said upper and lower shafts; and (c) counterweight means connected to said slide;

(d) said counterweight means providing a slight tension to film fed over said plurality of upper and lower guide rolls.

8. The apparatus of claim 3, further characterized by (a) each of said separate sensing means is a lever mounted on said common shaft; and (b) a feeler roll mounted on the end of each lever adjacent its respective upper guide roll.

9. The apparatus of claim 8, further characterized by (a) an electrically conducting rod mounted adjacent the end of each of said levers opposite their respective upper guide rolls; and (b) an electrical contact on each said lever for engaging said rod.

10. The apparatus of claim 9, further characterized by (a) an annular groove on each of said upper guide rolls; and (b) each of said feeler rolls engaging its respective annular groove.

* * * * *